US006322856B1

(12) United States Patent
Hislop

(10) Patent No.: US 6,322,856 B1
(45) **Date of Patent: *Nov. 27, 2001**

(54) POWER INJECTION FOR PLASMA THERMAL SPRAYING

(76) Inventor: Gary A. Hislop, 20901 Paseo Pino, Lake Forest, CA (US) 92630

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/506,621

(22) Filed: Feb. 18, 2000

Related U.S. Application Data

(63) Continuation of application No. 09/506,621, filed on Feb. 18, 2000.

(60) Provisional application No. 60/121,976, filed on Feb. 27, 1999.

(51) Int. Cl.[7] ..... C23C 4/12; B05B 1/24

(52) U.S. Cl. ..... 427/446; 219/76.16; 239/79; 239/85; 118/302

(58) Field of Search ..... 427/446; 219/76.16; 239/79, 85; 118/302

(56) References Cited

U.S. PATENT DOCUMENTS 4,866,240 * 9/1989 Webber ..... 219/76.16

OTHER PUBLICATIONS

Thermal Spraying: Practice, Theory, and Application, American Welding Society, Inc. pp. 9–12, 1985 (no month available).*

* cited by examiner

*Primary Examiner*—Katherine A. Bareford
(74) *Attorney, Agent, or Firm*—Small Larkin, LLP

(57) ABSTRACT

The present invention relates to a plasmatron for a plasma coating apparatus including an anode having an axial bore through which gas is passed around a cathode and an electric arc is established between the anode and cathode. A powder feed line or conduit is connected between the anode and a powder feed source. The feed line has a straight section along a portion of its length terminating at the axial bore of the anode. The straight section of feed line has a ratio of length to internal diameter at least about 4.8, preferably 10 and even more preferably 15.

25 Claims, 4 Drawing Sheets

POWER INJECTION FOR PLASMA THERMAL SPRAYING

This is a continued prosecution application of application Ser. No. 09/506,621, filed Feb. 18, 2000, which claimed priority from provisional application Ser. No. 60/121,976, filed Feb. 27, 1999.

BACKGROUND OF THE INVENTION

1. Field of the Invention

The present invention relates to plasma coating of coating materials on a substrate, and more particularly to equipment and processes for injecting powder into a plasma coating machine.

2. Description of the Prior Art

One of the ongoing problems in the plasma coating industry is "spitting" of prematurely molten powder from the plasmatron or plasma gun. Spitting becomes more of a problem when coating large parts, continuously over a relatively long period. Spitting can occur when applying metal and/or ceramic coatings. When spitting occurs the affected parts have to be stripped and re-coated, and this has a major cost impact.

Several factors are believed to contribute to spitting. One of the major factors is the way powdered material is injected into the plasma stream. Most plasma systems have plasma guns with external powder injection, whereby the powdered coating materials are injected into the plasma stream outside of the anode of the plasma gun through use of inert gas and a tubular injection conduit. Although this outside powder injection reduces the risk of spitting, it also reduces the deposit efficiency as well as the coating quality.

The most efficient way of conventionally injecting powder into a plasma stream is internally, that is, whereby the powdered coating materials are injected into a space between the anode and cathode of the plasma gun through use of inert gas and a tubular injection conduit. This internal powder injection method produces superior quality coatings, but does so at an increased risk of spitting.

Other factors that contribute to spitting are believed to be distance between the arc discharge and the point injection; the temperature of the plasma; and the energy concentration of the plasma. It is known that powder injection close to the arc discharge into a very hot and concentrated plasma stream with high energy density can result in premature melting of the powdered material.

OBJECTS AND SUMMARY OF THE INVENTION

The present invention relates to equipment and processes for positioning powder injection ports in a plasma coating machine to minimize and/or prevent spitting of prematurely molten powder.

In accordance with the present invention, it has been discovered that not only are the injection angles relative to the plasma stream, important both in axial and radial direction, but also that the length of the powder injection conduit in relation to its diameter has a significant influence on spitting. It has been discovered that if the length of the powder injection conduit adjacent the entrance to the plasma stream is greater than 4.8 times its diameter, without any substantial interruption or deviation in diameter throughout this length, spitting is reduced by a factor of about 4.

BRIEF DESCRIPTION OF THE DRAWINGS

Other objects and advantages of the invention will become apparent from the foregoing detailed description taken in connection with the accompanying drawings, in which.

DESCRIPTION OF THE PREFERRED EMBODIMENTS

Figure 1:
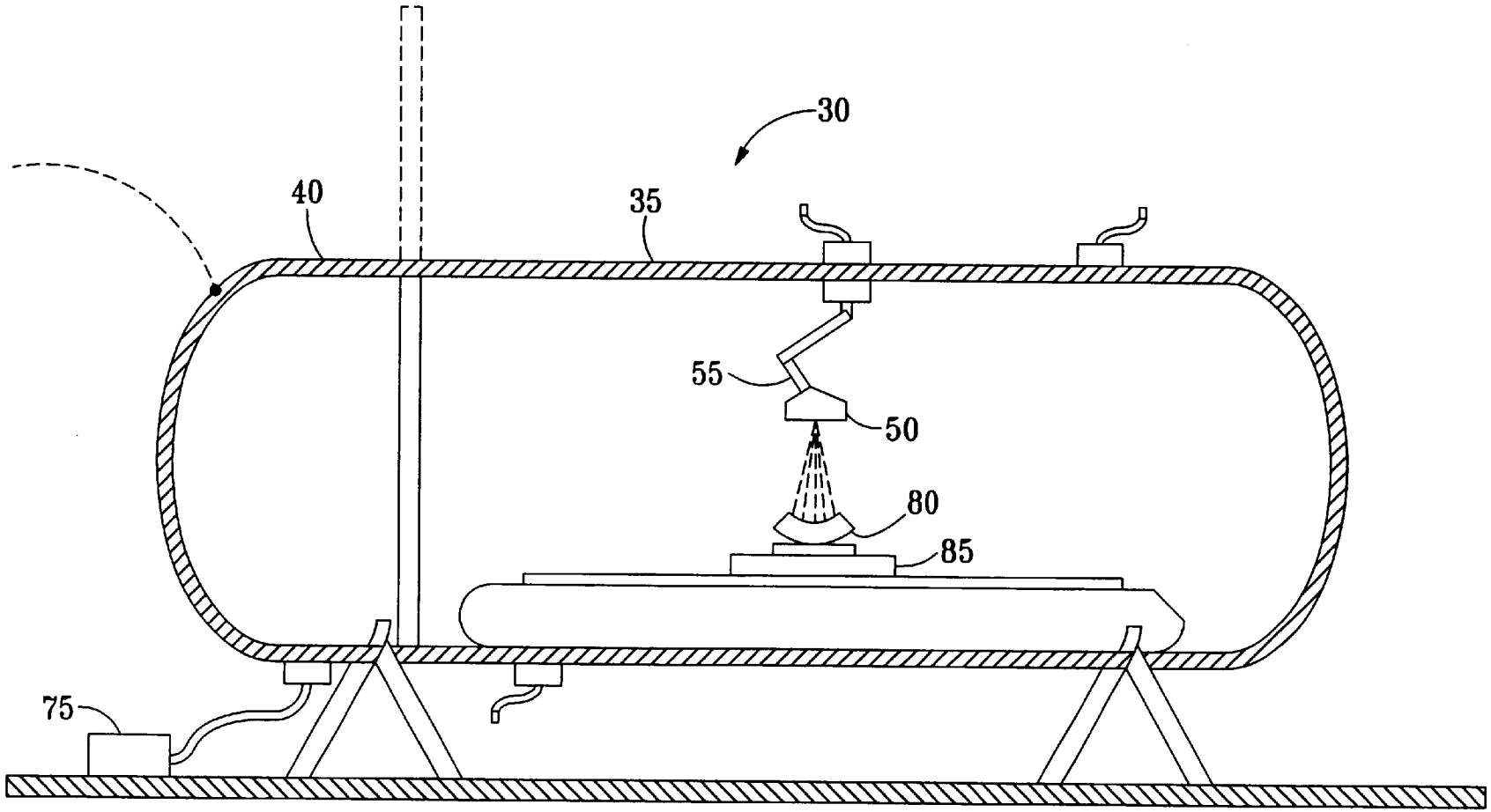
FIG. 1 is a schematic sectional elevation view of a plasmatron in a plasma coating system, shown depositing a coating onto a substrate using a coating material in powder form.

Turning now to the drawings, wherein like reference numerals designate like or corresponding parts, and more particularly to FIG. 1 thereof, an apparatus 30 is shown for plasma deposition of materials onto a substrate. The plasma spray machine 30, made by Electro-plasma, Inc. in Irvine, Calif., is available now from Sulcer Metco Company in Switzerland. It is used primarily for depositing nickel alloys and other specialized material on various parts, such as turbine blades for protection from the high temperature erosion influences in jet turbine engines.

The plasma spray machine 30 includes a main chamber 35 within which a low pressure, inert gas atmosphere can be established. The enclosure includes a transfer chamber 40 through which parts can be passed into and out of the main chamber 35 without contaminating the atmosphere in the main chamber 35 or affecting the gas pressure therein. Gas feed and exhaust lines connect to fittings on the main chamber 35 and the transfer chamber 40 for exhausting and purging to establish the desired atmospheric composition and pressure. A plasmatron 50 is disposed in the main chamber 35, preferably on a robotic arm 55 by which the plasmatron 50 can be manipulated remotely within the chamber 35 by controls outside the chamber.

Figure 2:
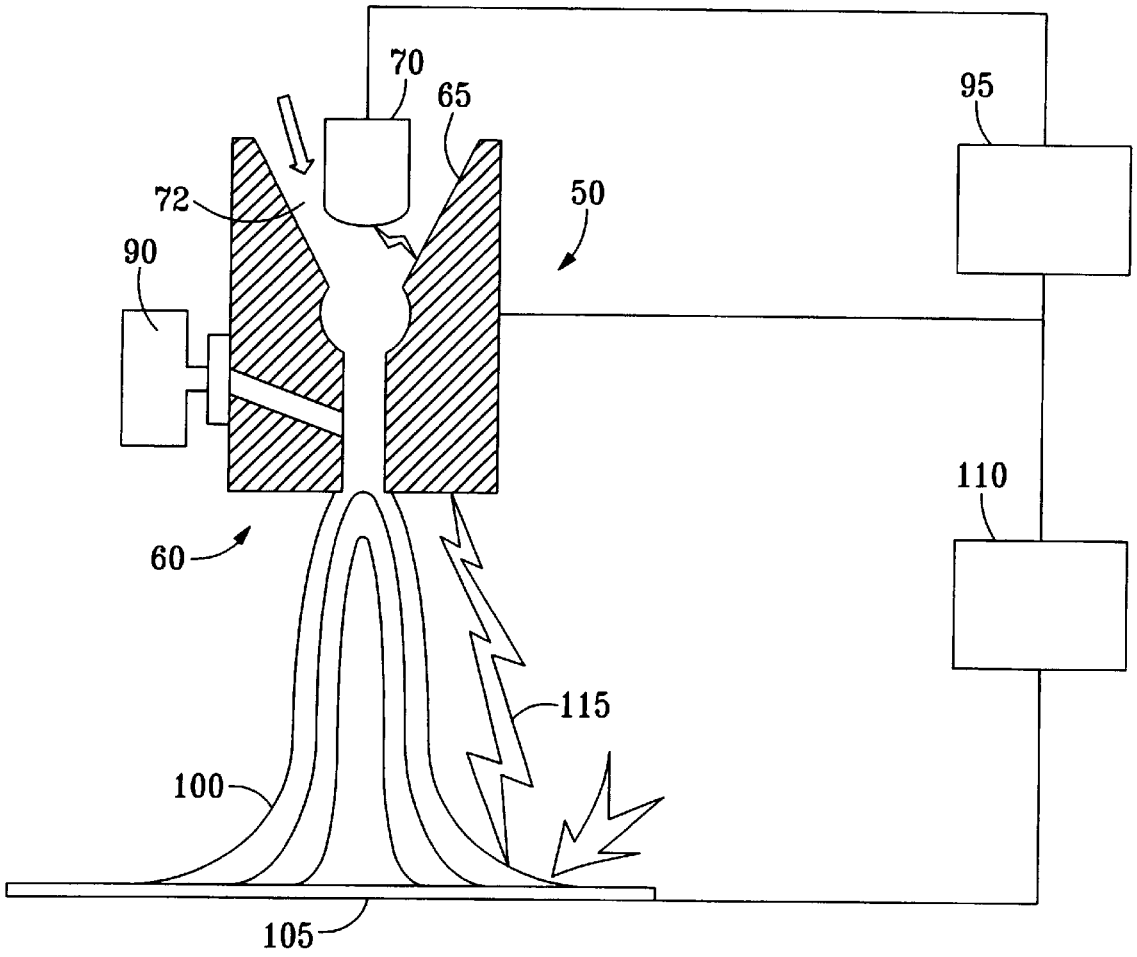
FIG. 2 is a schematic sectional elevation view of a prior art anode in a plasmatron of the type shown in FIG. 1.
Figure 4:
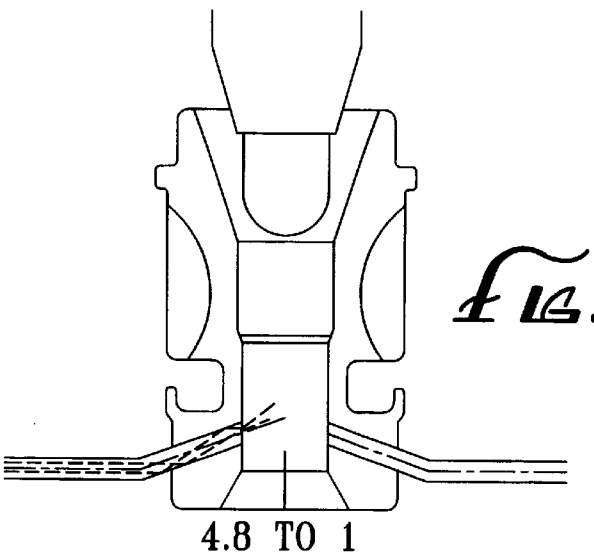
FIG. 4 is a schematic sectional elevation view of a preferred embodiment of a plasmatron in accordance with the present invention.

With reference to FIG. 2, the plasmatron 50 has a nozzle 60 and a conical cavity 65 within which a cathode 70 is suspended centrally, and an annular passage 72. The cathode 70 and the wall of the conical cavity 65 of the anode 60 are separated by an annular gap of about 0.150". This gap is commonly referred to as the "anode through diameter".

In operation, the main chamber 35 is evacuated to a pressure of about 50 militorr through one of the gas lines by a vacuum pump 75, and then backfilled with clean (99.995% pure) nitrogen or argon gas to about 300 torr. The chamber 35 is again evacuated to about 50 militorr and recharged with inert or non-reactive gasses such as argon or a mixture of argon and helium or argon and hydrogen to an operating pressure of about 30 torr. The hydrogen moiety is believed to function as an oxygen getter in the chamber, i.e., to reduce the oxygen content in the powder coating materials to negligible amounts, on the order of 15–30 ppm or less in materials that must have a low oxygen content.

One or more parts 80 are transferred into the chamber 35 from the transfer chamber 40. This transfer chamber 40 had been evacuated during each transfer operation to between 50 to 100 militorr, and backfilled to 100 torr, evacuated again and backfilled to 30 torr before opening the transfer valve. A part 80 previously put into the transfer 40 chamber is then manipulated into position under the plasmatron 50 by use of conventional, remotely operable manipulating equipment 85 in preparation for the coating operation.

Two powder sources 90 (only one of which is illustrated in FIG. 2) of known design and commercially available are filled with a powder of the coating material and evacuated to 50 militorr, then backfilled with pure argon to 4 psig. This process is repeated two more times to minimize the oxygen content in the powder feeders and in the powder. The powder is a gas atomized powder having particle diameters in the range of 10–45 micrometers. Powders used in these machines and processes are well known and commercially available from numerous suppliers.

During the coating process, a plasma gas comprising a mixture of about 82% argon and 18% hydrogen is flowed through the annular passage 72 at a rate of about 150 schf argon and 34 schf hydrogen. A conventional DC plasma power supply 95 is energized to create an arc in the passage 72, and 71.5 kW of power is applied at 1300 amp and 55 volts.

The plasma gas exits the nozzle 60 in a plasma gas stream at high temperature and velocity, and impinges on a part or substrate 105 positioned about 17 inches below the nozzle 60. The temperature of the part surface rises quickly to about 400° C. whereupon a negative DC transfer arc power supply 110 is energized to cause electrons to flow in a reverse transfer arc 115 out of the heated substrate surface and to flow countercurrent through the plasma gas stream 100 to the nozzle 60 (or to a separate electrode coupled to the plasma gas stream 100, not shown). The action of the reverse transfer arc 115 preferentially discharges at the substrate surface where oxides and other contaminants exist, and acts to vaporize and otherwise eliminate the contaminants until the substrate surface is metallurgically clean.

The powder feeders 90 are then turned on to feed powder at a rate of about 50 grams/minute with a carrier gas flowing at a rate of about 15 schf. The powder is entrained in the plasma gas stream 100 and ejected from the nozzle 60 at supersonic speeds. It travels with the plasma gas stream in a diverging or conically shaped flow pattern, and impacts against the substrate surface at high speed. The impact of the high energy and partially melted powder particles on the extremely clean substrate surface result in diffusion and flattening of the powder particles when they impact against the substrate surface. The diffusion of the powder particles into the substrate surface results in an intimate bond between the powder coating and the substrate surface.

Figure 3:
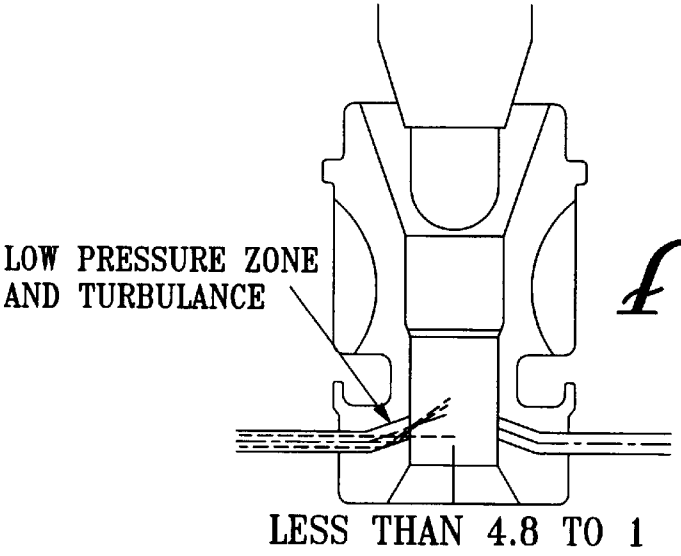
FIG. 3 is a schematic sectional elevation view of a prior art plasmatron.
Figure 6:
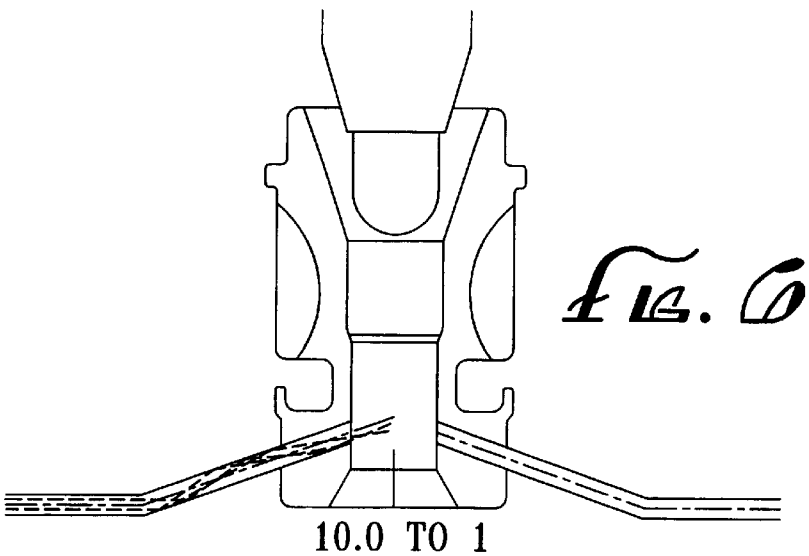
FIG. 6 is a schematic sectional elevation view of another alternate embodiment of a plasmatron in accordance with the present invention.
Figure 5:
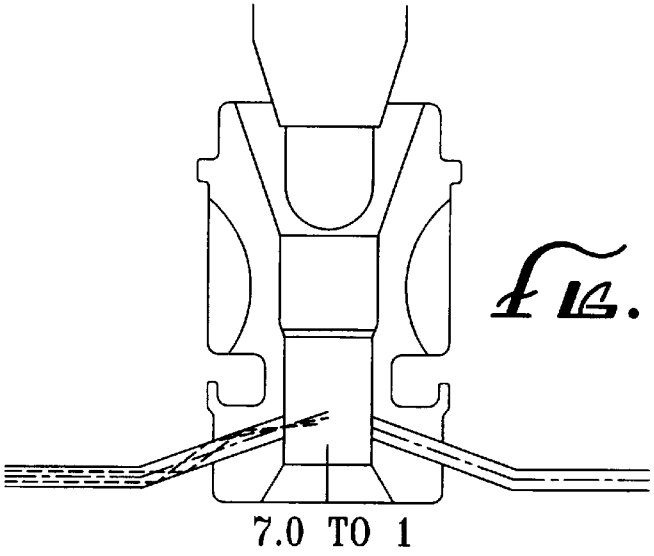
FIG. 5 is a schematic elevation view of an alternate embodiment of a plasmatron in accordance with the present invention.
Figure 7:
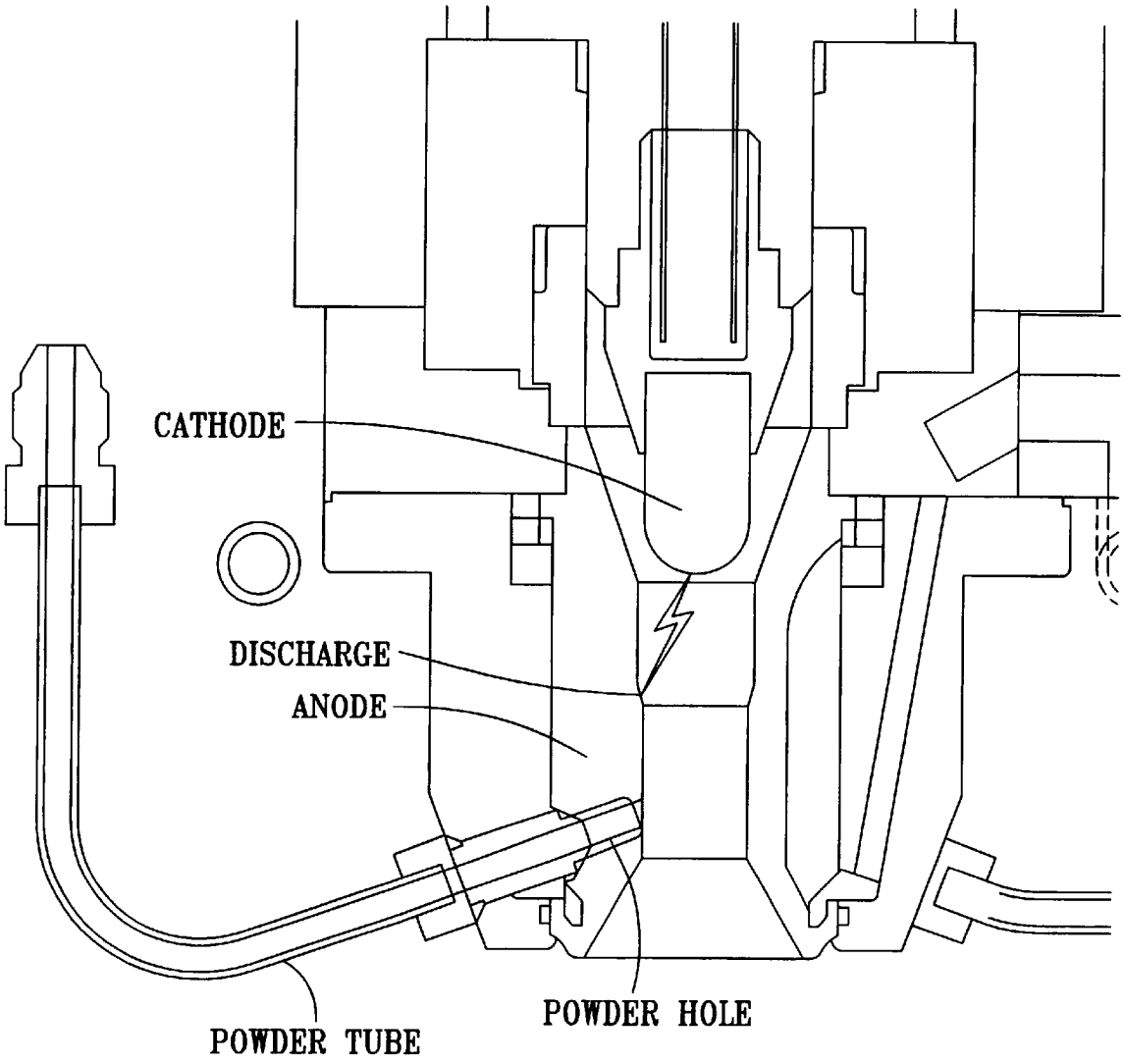
FIG. 7 is a sectional elevation view of the most preferred embodiment of the present invention.

In the standard design of the tubular powder injector, the powder injection conduit includes an external feed tube and a channel in the anode. The external tube is connected to and feeds into the tubular path a hole or channel in the anode, as shown in FIG. 3. The internal channel in the anode has a bend in it, and the ratio of the distance between this bend and the powder exit orifice at the anode wall is less than 4.8. As such, this powder injection conduit has a longitudinal centerline, or axis having two legs or sections at an acute angle to each other as shown in FIG. 3. It has been discovered that this bend, which is adjacent to or closest to the plasma stream creates turbulence of the powder flow within the conduit. The bent axis designs are believed to create the following problems:

1. High and low pressure zones are created in the powder injection conduit, which causes the finer particles to slow down relative to the larger particles, and this results in premature melting of the finer particles, while the larger particles continue moving along the conduit;
2. The bend in the powder injection conduit causes the powder stream to deflect and bounce off the conduit wall just before injection into the plasma stream at angles that are not the proper or ideal angle of injection; and
3. With an injection conduit length to diameter ratio of less than 4.8:1, due to the above two phenomena, the variously sized, entrained powder particles move at varying velocities and at different directions at the time of injection, thus causing spitting.

It has been discovered that using a powder injection conduit having a tubular shape and a length to diameter ratio of about 15:1, the following improvements were achieved:

1. Lowered risk of spitting by a factor of at least 4;
2. Increased deposition efficiency by about 3%, due to precise powder injection;
3. Improved coating quality due to a relatively lower amount of unmelted particles.

In accordance with the present invention it has been found that the risk of spitting with an internal powder injection plasma gun is reduced when the powder injection conduit is a tube, its length-to-diameter ratio is at least 4.8:1 and the tube is essentially straight over this length. Also, it has been discovered that the preferred powder injection tube length-to-diameter ratio is 10:1 or greater.

It has also been discovered that in the most preferred embodiment, the ratio of the powder injection tube diameter to anode through diameter is at least 4:1, and the ratio of the powder injection tube, in its straight portion, to its diameter is at least 4.8:1, and preferably 10:1 or greater.

Also, although tubular shaped powder injection lines are preferred, other cross sectional shapes, such as square, rectangular, oval, and triangular, are considered to be equivalent so long as they provide substantially the same results as do tubular-shaped powder injection lines.

It is understood that the above-described preferred embodiments examples, and figures are illustrative of the general principals of the present invention. Other formulations, arrangements, assemblies and materials may be used by those skilled in this art and embody the principals of the present invention. It will be understood that certain features and subcombinations are of utility and may be employed without reference to other features and subcombinations as they are outlined within the description above and within the claims appended hereto. While the preferred embodiments and application of the invention have been described, it is apparent to those skilled in the art that the objects and features of the present invention are only limited as set forth in the claims appended hereto.

I claim:

1. A method of plasma coating objects including:

evacuating a chamber in which a plasmatron including a cathode, an anode, and an axial bore in the anode is disposed to a predetermined vacuum;

charging the chamber with a non-reactive gas to an operating pressure;

placing an object in the chamber and in the plasmatron discharge path;

providing a source of powder to the plasmatron;

providing a plasma powder injection conduit having a predetermined length and terminating at and in communication with said axial bore and having an essentially straight uninterrupted section having a length of at least 4.8 times its internal diameter terminating at said axial bore;

creating a plasma stream in the plasmatron;

feeding powder from the powder source to the plasma stream through the plasma powder injection conduit;

heating the powder to high temperature by the plasma stream;

transporting the powder at high velocity by the plasma stream to the object; and impinging the powder on the object to create a coating.

2. The method of claim 1 wherein the powder injection conduit section terminating at said axial bore has a length of at least 10 times its internal diameter.

3. The method of claim 1 wherein the powder injection conduit section terminating at said axial bore has a length of at least 15 times its internal diameter.

4. The method of claim 1 wherein the powder injection conduit has an internal diameter at least 4 times greater than the minimum distance between the cathode and the axial bore in the anode.

5. A plasmatron for a plasma coating apparatus, comprising:

an anode, a cathode, and an axial bore in the anode;

a powder injection conduit operatively connected to said anode and to a powder feed source, said injection conduit having a predetermined length and terminating at and in communication with said axial bore and having an essentially straight uninterrupted section terminating at said axial bore of said anode; and said straight section having a length of at least about 4.8 times its internal diameter.

6. The plasmatron of claim 5, wherein said straight section has a predetermined length at least about 10 times its internal diameter.

7. The plasmatron of claim 5, wherein said straight section has a predetermined length at least about 15 times its internal diameter.

8. The plasmatron of claim 5, wherein the minimum distance between the cathode and the axial bore in the anode defines the anode through diameter;

said straight section internal diameter is at least 4 times greater than the anode through diameter.

9. The plasmatron of claim 8, wherein the anode through diameter is about 0.150".

10. The plasmatron of claim 5, wherein said powder injection conduit is generally tubular in cross section.

11. The plasmatron of claim 5 wherein the ratio of the length of said straight section of the powder injection conduit to its diameter is adapted to lower the risk of spitting by a factor of at least 4.

12. The plasmatron of claim 5 wherein the ratio of the length of said straight section of the powder injection conduit to its diameter is adapted to increase the deposition efficiency by about 3%.

13. A plasma coating system comprising:

a plasma spray machine having an internal powder injection conduit, a main chamber, a transfer chamber, at least one gas feed and exhaust conduit, a plasmatron including a cathode, an anode, and an axial bore in the anode, a DC plasma power supply, an AC plasma power supply, and remotely operable manipulative equipment;

the internal powder injection conduit having a section of a predetermined length, a predetermined internal diameter, operatively connected to and in communication with an injection powder source and terminating at the axial bore in the plasmatron anode; and the internal powder injection conduit terminating at and in communication with said axial bore and having an essentially straight uninterrupted section having a length of at least 4.8 times it internal diameter terminating at said axial bore.

14. The system of claim 13 wherein the internal powder injection conduit straight section length terminating at said axial bore is at least about 10 times its internal diameter.

15. The system of claim 13 wherein the internal powder injection conduit straight section length terminating at said axial bore is at least about 15 times its internal diameter.

16. The system of claim 13 wherein the internal powder injection conduit section internal diameter is greater than the minimum distance between the cathode and the axial bore in the anode.

17. The system of claim 13 wherein the conduit section is tubular in cross section.

18. A plasmatron for a plasma coating apparatus, comprising:

an anode, a cathode, and an axial bore in the anode;

a gap between said cathode and said axial bore having a predetermined minimum distance;

a powder injection conduit operatively connected to said anode and to a powder feed source, said injection conduit terminating at and in communication with said vial bore and having an essentially straight uninterrupted section terminating at said axial bore of said anode;

said straight section having a length of at least about 4.8 limes its internal diameter; and said internal diameter being greater than said minimum distance between the cathode and the axial bore in the anode.

19. The plasmatron of claim 18, wherein said straight section has a predetermined length of at least about 10 times its internal diameter.

20. The plasmatron of claim 18, wherein said straight section has a predetermined length of at least about 15 times its internal diameter.

21. The plasmatron of claim 18, wherein said straight section internal diameter is at least 4 times greater than said minimum distance between the cathode and the axial bore in the anode.

22. The plasmatron of claim 21, wherein said minimum distance between the cathode and the axial bore in the anode is about 0.150".

23. The plasmatron of claim 18, wherein said powder injection conduit is generally tubular in cross section.

24. The plasmatron of claim 18, wherein the ratio of the length of said straight section of the powder injection conduit to its diameter is selected to minimize the risk of spitting.

25. The plasmatron of claim 18, wherein the ratio of the length of said straight section of the powder injection conduit to its diameter is selected to increase the deposition efficiency.

* * * * *